United States Patent [19]

Burns et al.

[11] Patent Number: 4,917,187

[45] Date of Patent: Apr. 17, 1990

[54] METHOD AND APPARATUS FOR HYDRAULICALLY FIRING A PERFORATING GUN BELOW A SET PACKER

[75] Inventors: Robert E. Burns, Houston; Elmer R. Peterson, The Woodlands, both of Tex.

[73] Assignee: Baker Hughes Incorporated, Houston, Tex.

[21] Appl. No.: 300,795

[22] Filed: Jan. 23, 1989

[51] Int. Cl.[4] ..... E21B 33/12; E21B 43/116

[52] U.S. Cl. ..... 166/297; 166/55; 166/133; 166/188; 175/4.52

[58] Field of Search ..... 166/55, 55.1, 297, 298, 166/133, 183, 188; 175/4.52

[56] References Cited

U.S. PATENT DOCUMENTS

| | | | |
|---|---|---|---|
| 2,894,587 | 7/1959 | McCulloch | 166/183 X |
| 4,540,047 | 9/1985 | Akkerman | 166/188 |
| 4,817,718 | 4/1989 | Nelson et al. | 175/4.52 X |

*Primary Examiner*—William P. Neuder

*Attorney, Agent, or Firm*—Hubbard, Thurman, Turner & Tucker

[57] ABSTRACT

An improved packer is provided for sealingly engaging a well casing above a pressure responsive device within a petroleum recovery well. A sleeve-like packer body interior of the packer sealing elements is provided for structurally interconnecting lower and upper sections of a tubing string, and retains a large internal diameter for passing fluids or various downhole tools through the tubing string and to the bore of the packer. A plurality of tubular passageways are provided within the packer each positioned radially between the packer body and the packer sealing elements, and each extending axially from above to below the packer sealing elements. The passageways allow for communications of a fluid pressure signal from the annulus above the set packer to the firing head of a hydraulically actuatable device below the packer. The tubular passageways may be positioned within a second flow passageway open to annulus pressure both above and below the packer sealing elements when the packer is in its unset position, with the second passageway becoming automatically closed at one end when the packer is set in the well bore.

31 Claims, 2 Drawing Sheets

METHOD AND APPARATUS FOR HYDRAULICALLY FIRING A PERFORATING GUN BELOW A SET PACKER

FIELD OF THE INVENTION

The present invention relates to packers and techniques for hydraulically firing a pressure responsive device, such as a perforating gun, below a set packer. More particularly, the present invention relates to a test packer for setting within a well bore above a perforating gun, with the packer including a fluid passageway for firing the gun by a change in annulus pressure above the set packer.

BACKGROUND OF THE INVENTION

Various techniques have been devised for actuating or firing a perforating gun in a subterranean well. A bar or "go-devil" may be dropped through the interior of the tubing string for mechanically firing the gun, or for breaking a ceramic disc to significantly alter tubing fluid pressure to the gun, and thereby hydraulically firing the gun. A signal may be sent downhole through an electric line to initiate the firing of the gun, or to release stored electrical energy for firing the gun. In many applications, however, neither a go-devil nor an electric line is a preferred technique for firing the gun, partially due to problems associated with reliability of the gun firing, post-gun firing difficulties associated with using tubing fluid pressure or an electric line to fire the gun, and the expense of running the electric line.

Firing of a perforating gun by altering hydraulic pressure in the annulus between the tubing and the casing has long been an acceptable alternative. Annulus fluids above the packer are customarily isolated from the production fluids by the packer, and annulus pressure can be easily controlled at the surface using readily available pumps. Accordingly, many operators prefer techniques for altering annulus pressure to reliably and inexpensively fire a downhole perforating gun. In many such applications, however, it is also preferred that the packer above the perforating gun be set prior to firing the gun, so that formation fluids and pressure are initially isolated from the annulus between the tubing and the casing above the set packer from the moment the gun is fired.

In order to achieve hydraulic firing of a gun by regulating annulus pressure above the set packer, annular flow passageways positioned radially inward of the sleeve-like packer body and isolated from the tubing bore have been utilized. These flow passageways transmit fluid pressure from the annulus above the packer to the hydraulic firing head of the gun, thereby permitting the reliable and inexpensive firing of the gun. Such flow passages, however, create significant drawbacks which have heretofore limited the commercial acceptance of these packers, and accordingly of the related technique for hydraulically firing perforating guns below a set packer.

One of the drawbacks of prior art packers used for hydraulically firing guns by controlling annulus pressure relates to reduced flow capability through the tubing string. Each section of conduit between the formation and the surface of the well preferably has an internal diameter which is as large as practical up to the nominal diameter of the tubing, so that there are no significant restrictions or "chokes" along the tubing string. The outer diameter of the unset packer sealing elements must also be closely controlled so that the packer can be easily passed through a casing only slightly greater than the diameter of the tubing. Also, the inner diameter of the packer body preferably is not significantly less than the bore diameter of the tubing above or below the packer, as explained above. Accordingly the permissible radial "thickness" of the packer between the interior surface of the packer body and the external surface of the packer sealing elements when in the unset condition must be closely controlled. This "maximum flow capacity" feature of the packer and accordingly of the tubing string does not generally exist, however, when an inner mandrel is provided within the packer body for forming an annular passageway to transmit fluid pressure from the annulus between the tubing and the casing above the set packer, between the inner mandrel and the packer body, and thence to the hydraulic firing head of a gun.

Another drawback relating to prior art packers used for hydraulically firing a perforating gun is that various equipment cannot be easily and reliably passed through the packer bore if one or more flow lines are provided interior of the packer body. It may be desirable to pass various downhole tools, such as a wireline perforating gun, through the tubing string and the bore of the set or unset packer within the well bore. Such a gun can, however, easily get "hung up" on small tubing positioned radially interior of the packer body, thereby causing an expensive retrieval or "fishing" operation, or adversely affecting the reliability of the downhole equipment.

The disadvantages of the prior art have been overcome by the present invention, however, and improved methods and apparatus are hereinafter disclosed for reliably firing a perforating gun positioned below a set packer in a subterranean well by transmitting a pressure signal from the annulus between the tubing and the casing above the set packer to the perforating gun below the set packer.

SUMMARY OF THE INVENTION

A packer according to the present invention comprises a sleeve-like packer body for structurally interconnecting the tubing above the packer to the tubing below the packer. The packer body has a cylindrical interior surface which may be substantially equal in diameter or slightly less than the interior surface of the tubing, so that the packer and thus the tubing string along which the packer is positioned can pass fluids at a high rate and can reliably pass various downhole tools through the packer bore. A plurality of annular elastomeric packer sealing elements are provided radially exterior of the packer body for sealing the annulus between the casing and the tubing string. One or more flow passageways are provided spaced radially between the packer body and the elastomeric packer elements for receiving a selected fluid at the surface.

The flow passageway is preferably formed by a small diameter tubing, which may be positioned within a second flow path between the packer body and the various radially exterior packer components. The first flow path may be filled with a selected fluid while the packer is at the surface. The packer may then be positioned in the well with the perforating gun below the packer, and the packer set to close off the second passageway. Fluid pressure in the annulus above the set packer is controlled at the surface. An increase in annulus fluid pressure will cause a corresponding increase in pressure in the first flow passageway, thereby transmitting a firing signal to the gun head and firing the perforating gun.

In a suitable embodiment of the invention, the first flow passageway is filled with water at the surface. The packer is mechanically set in the well by picking up and rotating the tubing through a J-slot arrangement, then slacking off or "setting down" on the tubing to (a) cause slips axially positioned below the packer sealing elements to grip the casing, (b) to axially compress and thus radially expand the packer sealing element against the casing, and (c) to close a packer bypass valve at the upper end of the second passageway and thus isolate annulus pressure above the packer from annulus pressure below the packer. The packer may subsequently be unset by lifting up on the tubing to open the bypass valve, thereby equalizing the pressure above and below the packer sealing elements and releasing the radial outward force on the slips and the packer sealing elements. Various packer components thus move axially with respect to the packer body during the packer setting and unsetting operations, although the tubing which defines the first flow passageway between the packer body and the packer elements remains stationary with respect to the packer body.

It is thus a feature of the present invention to provide an improved packer for use in a subterranean well bore above a hydraulically actuatable perforating gun, so that fluid pressure in the annulus between the tubing and the casing may be used to reliably fire the gun with the packer in the set position, and without transmitting fluid pressure axially past the packer sealing elements at a position radially inward of the packer body.

It is a further feature of the present invention to provide improved techniques for actuating a perforating gun below a set packer by regulating pressure in the annulus between the tubing and the casing in a subterranean well, whereby the interior of the packer body retains a "full bore" diameter substantially equal to the diameter of the tubing string above and below the packer.

These and other features and advantages of the present invention will become apparent from the following detailed description, wherein reference is made to the figures in the accompanying drawings.

DETAILED DESCRIPTION OF PREFERRED EMBODIMENTS

Figure 1:
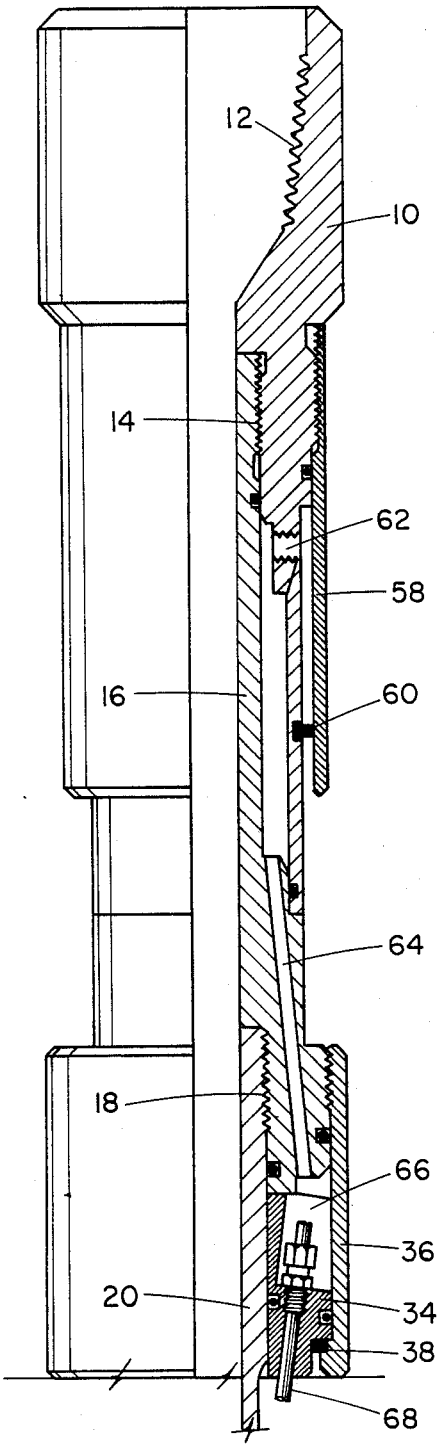
FIGS. 1, 2 and 3 are sequential half-sectional views of a suitable packer according to the present invention.
Figure 2:
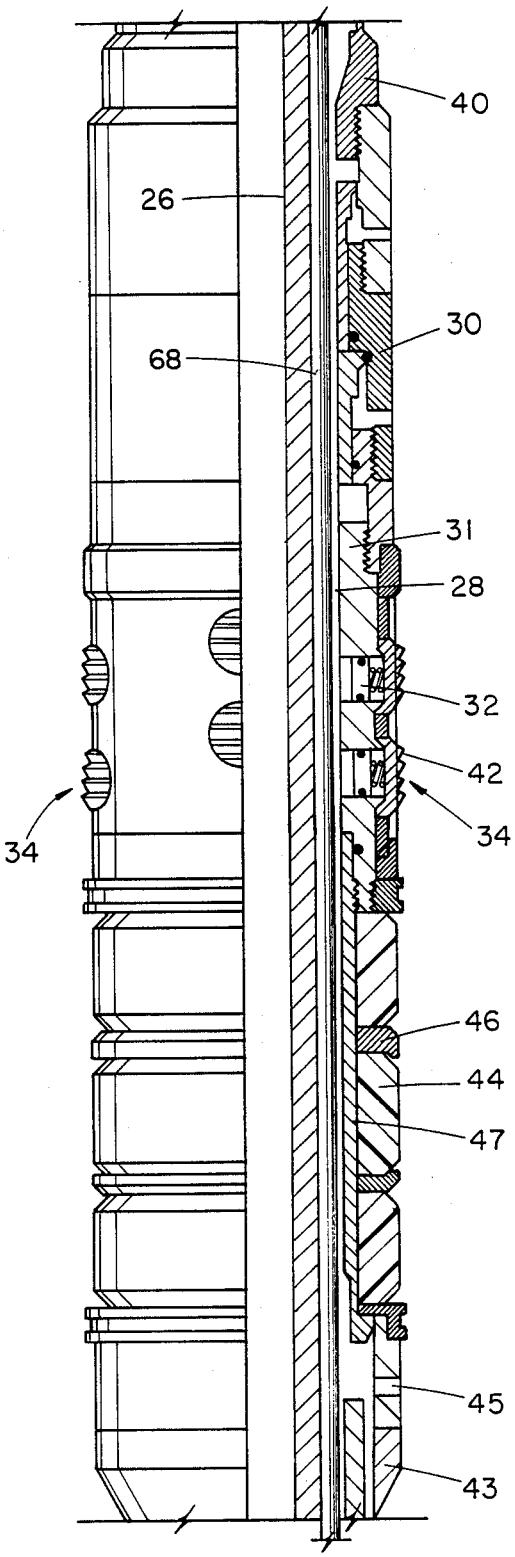
Figure 3:
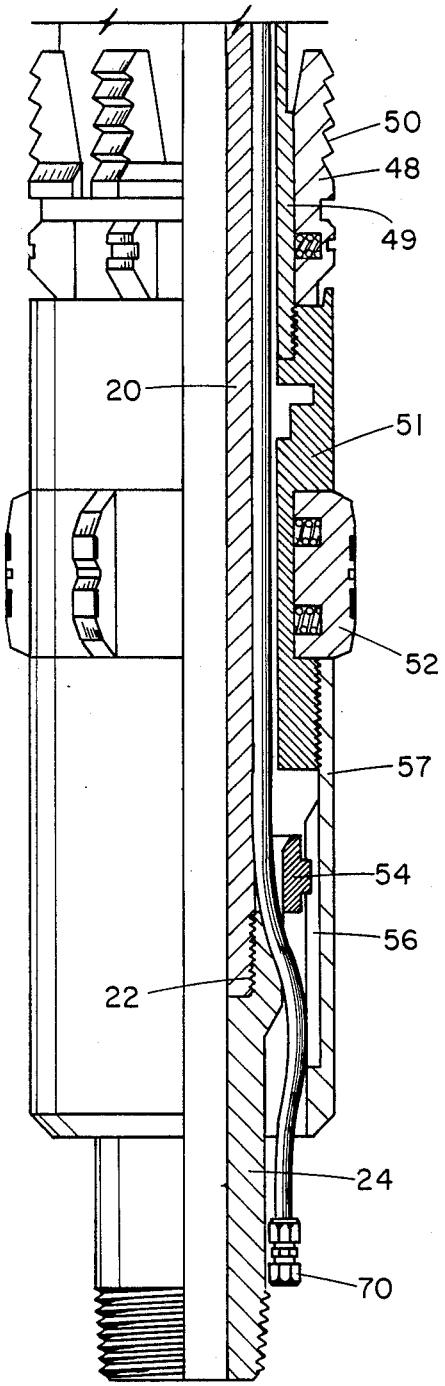

FIGS. 1, 2, and 3 depict upper, intermediate, and lower portions respectively of the packer assembly according to the present invention for transmitting fluid pressure signals from an annulus between the tubing and the casing to a firing head of a perforating gun. As those skilled in the art appreciate, the term "packer" as used herein refers to the assembly interconnected between upper and lower sections of a tubular string for sealing the annulus between the tubing string and the casing or sides of the "open" hole. A downhole packer typically is a complex assembly, which representatively may include one or more slips for mechanically connecting the tubing and the casing, a plurality of hydraulically actuated hold down "buttons" or gripping members, a plurality of elastomeric packer sealing members, and mechanisms for actuating or setting the slips, the gripping members, and the packer sealing elements.

Referring to FIG. 1, the upper portion of the packer includes a top sub 10 having upper threads 12 for securing to a conventional upper length of tubing (not shown), and lower threads 14 for fixedly connecting to a water or fluid leg sub 16. Sub 16, in turn, is threaded at 18 to a sleeve-like packer body 20, which has threads 22 at its opposing end (see FIG. 3) for connecting to the bottom sub 24. Sub 24 has conventional threads 26 for securing to another lower length of tubing (not shown).

The packer body 20 is preferably a unitary, tubular-like member which, in cooperation with conventional threaded subs, structurally interconnects the upper portion of tubing above the packer to the lower portion of tubing below the packer, and thereby allows significant axially-directed and rotational forces to be transmitted along the tubing string. The packer body 20 thus serves to fulfill the purpose and function of the tubing in the vicinity of the packer, namely to provide a concentric interior bore for passage of both fluid flow and other downhole equipment, and to provide the necessary structural interconnection between lengths of tubing to reliably transmit high axial and/or rotational forces. The inner surface 26 of the packer body 20 has a cylindrical configuration, with a diameter preferably substantially equal to or only slightly less than the inner diameter of the tubular string above and below the packer. Since the packer of the present invention thus has no components which extend radially inward of the body 20, the packer may be "full bore" which is defined to mean a passageway diameter of approximately $2\frac{1}{4}$ inches, rather than being "non-full bore" or less than the recognized $2\frac{1}{4}$ inch "full bore" standard. Also, it can be seen that none of the interconnecting subs 10, 16, or 24 extend radially inward of the surface 26. The packer of the present invention can readily pass well fluids through its interior bore and does not substantially restrict flow through the tubing string. Equally important, no components are positioned radially interior of the inner cylindrical surface 26 of body 20, so that various downhole tools can be passed through the bore of the packer without substantial risk of getting "hung up" within the packer, and without risking damage to either the downhole tools or the packer.

A valve sealing sub 34 is fixed to the sub 16 and thus the packer body 20 by sleeve member 36, with a valve seal 38 fixedly sandwiched therebetween. A valve member 40 is fixed to an outer housing 30 of the packer, and seals against seal 38 as described subsequently upon axial movement of housing 30 toward sub 34. A flow channel 28 is provided between the packer body 20 and the outer housing 30 of the packer for transmission of fluid pressure to move radially outward the pistons 32 with respect to hold down button housing 31, and thereby activate each of the hold down buttons 34 circumferentially spaced about the housing 31. The hold down buttons 34 are each depicted in FIG. 2 in their retracted position, and include upwardly facing teeth 42 for engagement with the casing to prevent upward movement of the housing 31 and thus the interconnected packer sealing elements. A sleeve-like packer support housing 47 is threadable connected to housing 31, with the plurality of elastomeric sealing elements 44 mounted on housing 47. The sealing elements 44 are separated by spacer element 46, and can be compressed axially, as described subsequently, so that the sealing elements are forced radially outward into sealing engagement with the casing.

A plurality of slips 48 beneath the tubular sealing elements 44 include downwardly facing teeth 50. Drag blocks 52 mounted on housing 51 are provided for engaging the walls of the casing and thereby inparting a resistance to allow the slips to be set. Lug 54 is provided within the J-shaped slot 56 of outer housing 57 for facilitating the slip setting operation. The slips 48 are forced radially outward with respect to inner housing 49 during the packer setting operation for biting engagement with the casing.

The packer setting operation will now be briefly described. The packer assembly is run into the well in the "open" position as shown in FIGS. 1, 2 and 3. Fluid is thus allowed to freely circulate through and around the packer elements, and particularly through the flow path 28 which at this time is not sealed from the annulus at either its lower or upper ends. Once the packer is positioned at its desired depth in the well bore, the tubing and thus the packer body 20 is raised slightly, allowing the drag blocks 52 to engage the casing and thus create a nominal resistance to this upward movement. This resistance is sufficient for the lug 54 to raise up from its position in the bottom of the J-slot 56. The tubing may then be rotated to the right, so that the lug 54 will move clear of the J-slot. The tubing is then "slacked off", allowing the weight of the tubing to move the packer body 20 axially downard with respect to the packer sealing elements 44.

This "set down" action results in three separate operations within the packer: (1) the end of the valve 40 engages the seal 38, which thereby seals the upper end of the flow path 28 from the annulus above the packer elements, (2) the slips 48 engage the cone 43 positioned below the elements 44, which forces the slips radially outward to engage and grip the casing, and (3) the housing 31 moves axially downward with respect to the cone 43, thereby compressing the packer sealing elements 44 and forcing the elements radially outward into sealing engagement with the casing.

Once the packer is set, annulus fluid pressure above the packer is sealed from the passageway 28. An increase in annulus pressure below the set packer may, however, freely be transmitted to the passageway 28 through the port 45 or through gaps between the slip and the cone. No seals thus need be provided in the packer below the elements 44. An increase in annulus pressure below the set packer compared to annulus pressure above the set packer, which would typically occur when the perforating guns are fired and the formation fluids flow into the well bore, would tend to move the packer upward within the casing. This action is opposed, however, by the hold down buttons 34. An increase in annulus pressure below the set packer will thus be transmitted through passageway 28 to cause the buttons 34 to bite deeper into the casing, and accordingly the packer is prevented from slipping with respect to the casing.

To release or unset the packer, the tubing may be raised so that valve 40 disengages from seal 38, which opens passageway 28 to fluid pressure both above and below the packer and thereby equalizes pressure "across" the packer. The slip 48 and the cone 43 also disengage, thereby radially withdrawing the slips and releasing the axial compressive force on the packer sealing elements. The lug 54 and the J-slot 56 will automatically be re-engaged when the tubing is thereafter slightly lowered, so that the packer may be retrieved, or may be repositioned and reset within the well bore.

A sleeve 58 is threadably connected to the top sub 10 and a port 62 provided through the top sub so that pressure may be transmitted from the annulus above the packer, between the sleeve 58 and the top sub 10, and to the spacing between the top sub 10 and the fluid leg sub 16. A wiper 60 positioned between the top sub 10 and the sleeve 58 allows fluid pressure to be easily transmitted past the wiper, but keeps particulate and debris from readily passing from the well bore through the port 62. One or more drilled passageways 64 in the fluid leg sub 16 thus opens the cavity 66 (between the outer housing 36, the packer body 20, fluid leg sub 16, and the valve sealing housing 34) to pressure in the annulus above the packer sealing elements. A tubular conduit 68 has its upper open end within the cavity 66, with its lower open end being provided with a conventional coupling 70 (see FIG. 3) for connection to another conduit 86 (shown simplistically in FIG. 4). Conduit 68 thus extends from above the valve 40 down past the hold down buttons 32, the packer sealing elements 44, the slips 48 and the drag blocks 52, and terminates at a suitable position adjacent the end of the packer. One or more flow conduits 68 are preferably provided within the passageway 28 between the packer body 20 and the various packer elements radially exterior thereof, as shown. To conserve space and insure that they do not interfere with axial movement of the packer components, tubular conduit 68 may be embedded within the wall of body 20. The passageway 28 may thus be a generally sleeve-shaped or annular passageway between the packer body and the various packer components which move axially with respect to the packer body, with the conduits 68 occupying a relatively small volume of passageway 28. The fluid passageway for supplying pressure to the hold down buttons thus substantially surrounds the conduits 68. Conduits 68, which may be formed from a slightly deformable stainless steel material, are axially fixed with respect to the body 20, and do not interfere with axial movement of the packer components during the packer setting and unsetting operations. Preferably at least two conduits 68 are provided for redundant gun firing operation, so that the necessary pressure signal may be transmitted through the packer even if one conduit were to become plugged or otherwise fail to communication pressure from above the set packer to the gun firing head.

Figure 4:
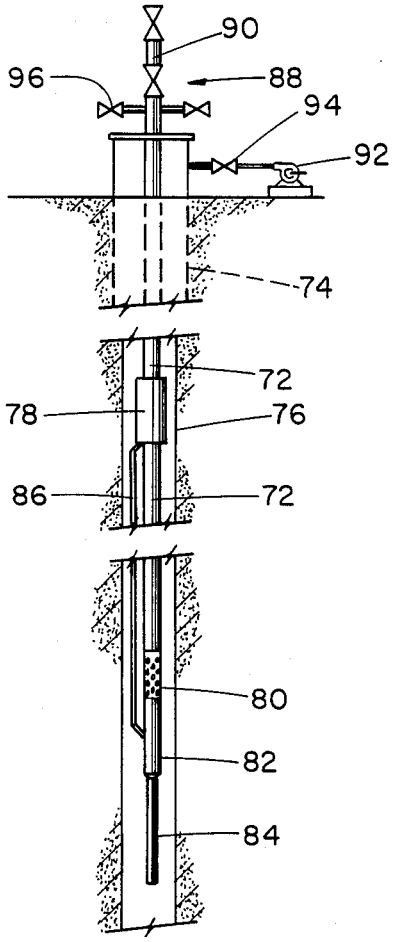
FIG. 4 a simplified pictorial view of a tubing string including a packer according to the present invention extending from the surface to a perforating gun in a subterranean well.

The packer of the present invention may typically be used for a flow test operation to better determine the characteristics of the hydrocarbon formation being tested. A test wellhead 88 is typically provided at the surface of the well, with one or more valves 96 for regulating pressure within the tubing 72 and a test flow line 90 for recovering test fluid. Conventional pump 92 and a plurality of valves and flow regulators 94 typically provided at the surface for maintaining a desired pressure within the annulus between the tubing and the casing. Large diameter casing 74 would typically be provided at the surface of the well, although the casing will generally telescope to a much smaller diameter in the vicinity of the perforating gun due to cost considerations. FIG. 4 is, of course, a simplified pictorial view, and it should be understood that the casing 76 may be much closer in diameter to the outer diameter of the unset packer, while the tubing line 86 between the packer and the perforating gun (discussed subsequently) is generally secured to the lower portion of the tubing string 72.

A discussion of the method of the present invention follows. One or more small diameter conduits 86 are each typically connected at one end to a hydraulic firing head 82 of a conventional perforating gun 84. A perforated nipple 80 or other flow bypass mechanism is typically provided above the gun for receiving well fluids into the tubing string 72 for either production or test purposes. Packer 78 which is shown in greater detail in FIGS. 1–3, is threadably connected to a lower end of the tubing string 72, and the conduits 86 are each connected to an end coupling 70 (see FIG. 3) of a respective conduits 68. The chamber 66, conduits 68, and conduits 86 may then be filled with a selected fluid, e.g., water or filtered oil, so that pressure can be subsequently transmitted to the gun without well fluids entering the small diameter conduits 68 and 86. Upper tubing strings are then threaded to the packer, until the packer is lowered to its desired position within the well bore.

The packer 78 may then be set in a conventional fashion. With the packer in the set condition, the annulus above the packer is sealed from the annulus below the packer by the valve 40. If desired, pressure throughout the length of the tubing string 72 may thus be reduced, so that the pressure in the annulus below the set packer is then in an "underbalanced" condition.

The perforating guns 84 may then be fired by using the pump 92 and valves 94 to increase annulus pressure above the set packer. This increase in pressure will be transmitted through conduit 68 passing between the packer body and the elastomeric sealing members, and will then be transmitted along conduits 86 to the gun firing head. The procedure for firing the gun does not in any way involve utilizing components within the interior of the packer body 20 nor the transmission of pressure signals through the bore of the packer body.

The present invention is particularly well adapted for use with a mechanically set test packer as described herein. The concept of the present invention may, however, also be applied to retrievable or nonretrievable production packers, hydraulically set packers or wireline set packers. The terms "tubing" or "tubing string" should be understood to broadly encompass any tubular member positionable within a casing of a well bore, and specifically includes tubing used for formation test operations, production tubing used for long term recovery of hydrocarbons, coiled tubing, drill pipe, and similar strings of tubular members onto which a packer may be positioned within a well bore, thereby forming an annulus between the tubing string and the sides of the well bore. The present invention is also applicable to either cased or "open hole" operations.

Although this invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A packer positionable along a tubing string in a subterranean well bore interior of a casing and above a pressure responsive device, the packer adapted for sealing the annulus between the tubing string and the casing and including (a) a tubular packer body structurally interconnecting an upper portion of the tubing string having an upper tubing bore diameter and a lower portion of the tubing string having a lower tubing bore diameter of substantially the same diameter as said upper portion, and (b) one or more elastomeric packer sealing elements radially exterior of the packer body for sealing engagement with the casing, the packer further comprising:

the tubular packer body having a cylindrical interior surface defining a bore diameter of substantially the same diameter as said upper portion of the tubing string, such that the packer body has substantially full bore capability for transmitting production fluids and/or equipment through the tubing string and the packer body;

a pressure flow path radially between the packer body and packer sealing elements and axially extending above and below the packer sealing elements, respectively, the flow path being open to annulus pressure at its upper and lower ends when the packer is unset within the well bore;

means for expanding said elastomeric packer sealing elements to set said packer;

means responsive to setting said packer for closing said pressure flow path; and one or more flow conduits in said pressure flow path, each extending axially from above to below the packer sealing elements and positioned relative to the tubular packer body for transmitting fluid pressure signals from the casing annulus above said packer sealing elements after said packer is set for activating the pressure responsive device.

2. The packer as defined in claim 1, further comprising:

an exterior packer housing;

a liquid fill chamber positioned axially above the packer sealing elements and radially between the packer body and the exterior packer housing, the liquid fill chamber being in fluid communication with the one or more flow conduits for receiving a selected fluid at the surface for filling the fill chamber and the one or more flow conduits; and means for applying annulus pressure above said packer sealing elements to said selected fluid in said fill chamber.

3. The packer as defined in claim 1, further comprising:

radially movable slips positioned below the packer sealing elements and radially outward of the one or more flow conduits for gripping engagement with the casing when said packer is set.

4. The packer as defined in claim 3, further comprising:

a cone member positioned radially outward of the flow conduits and axially movable with respect to the slips for engaging the slips and forcing the slips radially outward into engagement with the casing.

5. The packer as defined in claim 1 further comprising:

hydraulically-responsive gripping members positioned axially above the packer sealing elements and radially outward of the one or more flow conduits for gripping engagement with the casing; and said pressure flow path communicating pressure from the annulus below the packer sealing elements to the gripping members.

6. The packer as defined in claim 1, 2 or 5 further comprising:

a packer support housing radially outward of the one or more flow conduits for supporting the packer sealing elements thereon, the packer support housing being axially movable with respect to the packer body for effecting setting of the packer within the well bore; and an axially movable compression member for axially compressing the packer sealing elements to obtain radial expansion of the packer sealing elements into sealing engagement within the well bore.

7. The packer as defined in claim 5, wherein said pressure responsive device comprises a perforating gun having a fluid pressure responsive firing mechanism and at least two flow conduits are provided within the flow path for sending redundant pressure signals to the perforating gun.

8. A packer positionable along a tubing string in a subterranean well bore and above a pressure responsive device, the packer adapted for sealing the annulus between the tubing string and sides of the well bore and including (a) a tubular packer body structurally interconnecting an upper portion of the tubular string and a lower portion of the tubular string said tubular packer body having a cylindrical interior surface defining a packer bore diameter, (b) one or more elastomeric packer sealing elements radially exterior of the packer body for sealing engagement with the sides of the well bore, and (c) an exterior packer housing, the packer further comprising:

a first flow path positioned radially between the tubular packer body and both the exterior packer housing and the packer sealing elements for communicating pressure from the annulus above the packer sealing elements to the pressure responsive device;

a second flow path in fluid isolation from the first flow path and positioned radially between the tubular packer body and both the exterior packer housing and the packer sealing elements, and extending axially from above to below the packer sealing elements, for transmitting pressure between the annulus below the packer and the annulus above the packer when the packer is in its unset position; and a shiftable closure member responsive to the setting of said packer for automatically sealing the upper end of the second flow path from annulus pressure when the packer is set within the well bore.

9. The packer as defined in claim 8, further comprising:

hydraulically-responsive gripping members positioned axially above the packer sealing elements and radially outward of the first and second flow paths for gripping engagement with the sides of the well bore; and the second flow path being open to the annulus below the packer sealing elements when the packer is set in the well bore to apply annulus pressure below the packer sealing elements to the gripping members.

10. The packer as defined in claim 8, further comprising:

a liquid fill chamber positioned axially above the packer sealing elements and radially between the packer body and the exterior packer housing, the liquid fill chamber being in fluid communication with the first flow path for receiving a selected fluid at the surface to fill the liquid fill chamber and the first flow path; and means for applying annulus pressure above said packer sealing elements to the selected fluid.

11. The packer as defined in claim 8, wherein:

the second flow path is a sleeve-shaped flow path; and said first flow path is formed by a tubular-shaped flow conduit physically positioned within the second flow path.

12. The method of actuating a pressure responsive device positioned below a packer set within a subterranean well bore, the packer including a tubular packer body structurally interconnecting an upper portion of the tubing string and a lower portion of the tubing string and packer sealing elements radially exterior of the packer body for sealing the annulus between the tubing string and the sides of the well bore, the method comprising the steps of:

forming an annular flow path around the packer sealing elements positioned between the packer body and the packer sealing elements;

forming a second flow path through the packer having its upper end adjacent to the annulus pressure above the packer sealing elements and having its lower end below the packer sealing elements, the flow path being positioned within the annular flow path;

interconnecting a flow line positioned exterior of the lower portion of the tubular string for establishing fluid communication between the lower end of the second flow path and the pressure responsive device;

filling said second flow path and said flow line at the surface with a selected fluid;

applying the pressure of fluid in the annulus above the packer sealing elements to said selected fluid; and generating an activating signal to actuate the pressure responsive device by selectively controlling pressure in the annulus above the set packer, through the set packer along the second flow path, and through the flow line to the pressure responsive device.

13. The method as defined in claim 12, further comprising:

providing hydraulically-responsive gripping members positioned axially above the packer sealing elements and radially outward of the flow line for gripping engagement with the casing;

forming a second flow path for communicating pressure from the annulus below the packer sealing elements to the gripping members; and positioning at least one tubular conduit within the second flow path to form the first flow path.

14. The method as defined in claim 13, wherein the setting of the packer in the well bore automatically closes an upper end of the second flow path to annulus pressure above the packer sealing elements.

15. The method as defined in claim 12, further comprising:

forming the tubular packer body with a cylindrical interior surface defining a bore diameter of at least 2¼ inches, such that the packer has substantially full bore capability for transmitting production fluids and/or equipment through the tubing string and the packer.

16. The method as defined in claim 12, further comprising:

providing radially movable slips below the packer sealing elements and radially outward of the flow path for gripping engagement with the casing.

17. A packer positionable along a tubing string in a subterranean well bore interior of a casing and above a perforating gun having a fluid pressure responsive firing head, the packer adapted for sealing the annulus between the tubing string and the casing and including (a) a tubular packer body structurally interconnecting an upper portion of the tubing string having an upper tubing bore diameter of at at least 2¼" and a lower portion of the tubing string having a lower tubing bore diameter of at 2¼", and (b) one or more packer sealing elements radially exterior of the packer body for sealing engagement with the casing, the packer further comprising:

the tubular packer body having a cylindrical interior surface defining a bore diameter of at least 2¼", such that the packer has substantially full bore capability for transmitting production fluids and/or equipment through the tubing string and the packer;

an annular flow passage surrounding said tubular packer body and bypassing said packer sealing elements when said packer is unset;

means responsive to setting of said packer for closing one end of said annular flow passage;

one or more tubular-shaped flow conduits each extending axially from above to below the packer sealing elements and positioned within said annular flow passage for transmitting fluid pressure signals to the firing head of the perforating gun;

means for filling said flow conduits with a selected fluid prior to insertion of the packer in the well; and means for subjecting said selected fluid to the annulus pressure above the packer sealing elements.

18. The packer as defined in claim 17, further comprising:

a pressure flow path radially between the packer body and packer sealing elements and axially positioned above and below the packer sealing elements, respectively, the flow path being open to annulus pressure at its upper and lower ends when the packer is unset within the well bore;

closure means for selectively sealing at least one end of the flow path from annulus pressure when the packer is set in the well bore; and the one or more flow conduits being positioned within the flow path.

19. The packer defined in claim 18, further comprising:

an exterior packer housing;

a liquid fill chamber positioned axially above the packer sealing elements and radially between the packer body and the exterior packer housing, the liquid fill chamber being in fluid communication with the one or more flow conduits for receiving a selected fluid at the surface to fill the fill chamber and the one or more flow conduits.

20. The packer as defined in claim 17, further comprising:

radially movable slips positioned below the packer sealing elements and radially outward of the one or more flow conduits for gripping engagement with the casing.

21. The packer as defined in claim 19, further comprising:

a cone member positioned radially outward of the flow conduits and axially movable with respect to the slips for engaging the slips and forcing the slips radially outward into engagement with the casing.

22. The packer as defined in claim 17, further comprising:

hydraulically-responsive gripping members positioned axially above the packer sealing elements and radially outward of the one or more flow conduits for gripping engagement with the casing; and a sleeve-shaped pressure flow path radially interior of the packer sealing elements for communicating pressure from the annulus below the packer sealing elements to the gripping members.

23. The packer as defined in claim 22, further comprising:

a packer support housing radially outward of the one or more flow conduits for supporting the packer sealing elements thereon, the packer support housing being axially movable with respect to the packer body for effecting setting of the packer within the well bore; and an axially movable compression member for axially compressing the packer sealing elements to obtain radial expansion of the packer sealing elements into sealing engagement within the well bore.

24. The packer as defined in claim 22, wherein at least two flow conduits are provided within the flow path for sending redundant pressure signals to the perforating gun.

25. A packer positionable along a tubing string in a subterranean well bore and above a perforating gun having a fluid pressure responsive firing head, the packer adapted for sealing the annulus between the tubing string and sides of the well bore and including (a) a tubular packer body structurally interconnecting an upper portion of the tubular string and a lower portion of the tubular string and body having a cylindrical interior surface defining a packer bore diameter, (b) one or more elastomeric packer sealing elements radially exterior of the packer body for sealing engagement with the sides of the well bore, and (c) an exterior packer housing, the packer further comprising:

a first flow path positioned radially between the tubular packer body and both the exterior packer housing and the packer sealing elements for communicating pressure signals from the annulus above the packer sealing elements to the firing head of the perforating gun;

said first flow path being filled at the surface with a selected fluid;

means for applying the annulus fluid pressure to said selected fluid;

a second flow path in fluid isolation from the first flow path and positioned radially between the tubular packer body and both the exterior packer housing the packer sealing elements, and extending axially from above to below the packer sealing elements, for transmitting pressure between the annulus below the packer and the annulus above the packer when the packer is in its unset position; and a closure member for automatically sealing at least one end of the second flow path from annulus pressure above the packer sealing elements when the packer is set within the well bore.

26. The packer as defined in claim 25, further comprising:

hydraulically-responsive gripping members positioned axially above the packer sealing elements and radially outward of the first and second flow paths for gripping engagement with the sides of the well bore; and the second flow path being open to the annulus below the packer sealing elements when the packer is set in the well bore to apply annulus pressure to the gripping members.

27. The method of firing a perforating gun positioned below a packer set within a well bore, the packer including a tubular packer body structurally interconnecting an upper portion of the tubing string and a lower portion of the tubing string and elastomeric packer sealing elements radially exterior of the packer body for sealing the annulus between the tubing string and the sides of the well bore, the method comprising:

forming a flow path through the packer and disposed at its upper end adjacent to the annulus pressure above the packer sealing elements and having its lower end below the packer sealing elements, the flow path being positioned radially between the packer body and the packer sealing elements;

interconnecting a flow line positioned exterior of the lower portion of the tubular string for establishing fluid communication between the lower end of the flow path and the perforating gun;

filling said flow path and said flow line at the well surface with a selected fluid;

transmitting the annulus pressure above the set packer to said selected fluid; and providing hydraulically-responsive gripping members positioned axially above the packer sealing elements and radially outward of the flow line for gripping engagement with the casing;

forming a second flow path for communicating pressure from the annulus below the packer sealing elements to the gripping members; and positioning at least one tubular conduit within the second flow path to form the first flow path.

28. The method as defined in claim 27, further comprising:

providing hydraulically-responsive gripping members positioned axially above the packer sealing elements and radially outward of the flow line for gripping engagement with the casing;

forming a second flow path for communicating pressure from the annulus below the packer sealing elements to the gripping members; and positioning at least one tubular conduit within the second flow path to form the first flow path within the at least one tubular conduit.

29. The method as defined in claim 28, wherein the setting of the packer in the well bore automatically closes an upper end of the second flow path to annulus pressure above the packer sealing elements.

30. The method as defined in claim 27, further comprising:

forming the tubular packer body with a cylindrical interior surface defining a bore diameter of at least 2¼ inches, such that the packer has substantially full bore capability for transmitting production fluids and/or equipment through the tubing string and the packer.

31. The method as defined in claim 27, further comprising:

providing radially movable slips below the packer sealing elements and radially outward of the flow path for gripping engagement with the casing.

* * * * *